United States Patent [19]

Barrett et al.

[11] Patent Number: 5,022,618

[45] Date of Patent: Jun. 11, 1991

[54] MAILBOX SUPPORT APPARATUS

[75] Inventors: Michael E. Barrett, Gainesville, Ga.; Thomas C. Laughon; Roy V. Nicholson, both of Hickory, N.C.

[73] Assignee: McCalla/Lackey Products Corporation, Hickory, N.C.

[21] Appl. No.: 477,246

[22] Filed: Feb. 8, 1990

[51] Int. Cl.[5] ..... A47G 23/02

[52] U.S. Cl. ..... 248/146; 232/39; 248/156

[58] Field of Search ..... 248/146, 150, 152, 156, 248/176, 508, 545, 412, 231.3; 232/39

[56] References Cited

U.S. PATENT DOCUMENTS

| | | | |
|---|---|---|---|
| 949,231 | 2/1910 | Hanson | 248/146 |
| 1,848,387 | 3/1932 | Shultz | 248/146 |
| 3,114,557 | 12/1963 | Cabot | 248/156 X |
| 3,169,742 | 2/1965 | Smith | 248/146 |
| 3,685,237 | 8/1972 | Johnson | 248/156 X |
| 4,120,446 | 10/1978 | Fuemmeler | 232/39 X |
| 4,403,730 | 9/1983 | Batson | 232/39 |
| 4,792,088 | 12/1988 | Bonnell | 232/39 X |
| 4,893,747 | 1/1990 | Roth | 232/39 |

*Primary Examiner*—Ramon O. Ramirez
*Attorney, Agent, or Firm*—Bailey & Hardaway

[57] ABSTRACT

A mailbox support apparatus having a mailbox mounting plate attached to a hollow post member includes a ground mount stake driving into the ground and received within the hollow post member.

9 Claims, 4 Drawing Sheets

MAILBOX SUPPORT APPARATUS

BACKGROUND OF THE INVENTION

This invention relates generally to the art of post supports and more particularly to the art of a post support adapted for a mailbox.

Various post supports have been developed in the past. For example, U.S. Pat. No. 1,179,931 discloses a post equipped with a foot to increase support. U.S. Pat. No. 3,317,168 discloses a support post for objects having an improved anchor for stabilizing the post. Other post supports are shown in U.S. Pat. No. 907,817, U.S. Pat. No. 919,807 and U.S. Pat. No. 1,702,165. However, while the prior art reveals improved methods of anchoring a vertical pole support into the ground it fails to provide a simple, inexpensive post support which is quickly and easily assembled and especially adapted to support a mailbox.

SUMMARY OF THE INVENTION

It is thus an object of the invention to provide a post support for a mailbox.

It is a further object of the invention to provide an attractive and inexpensive post support for a mailbox.

It is a further and more particular object of the invention to provide an attractive post support which can be quickly and easily assembled and installed.

These as well as other objects are accomplished by a mailbox support apparatus comprising a ground mount stake, spacer members attached to the ground mount stake. The ground mount stake with the spacer members thereon insertable into a hollow post member, whereby the hollow post member becomes secured in an upright position, and a mounting plate attached to the top of the hollow post member upon which a mailbox can be mounted. An additional embodiment of the invention provides a cross arm transversely insertable through the hollow post member and thereby held in a horizontal orientation, mounting brackets attached to the cross arm for supporting a mailbox.

DETAILED DESCRIPTION

In accordance with this invention it has been found that an attractive, inexpensive and easy to assemble mailbox support apparatus may be provided for readily mounting a mailbox.

Figure 1:
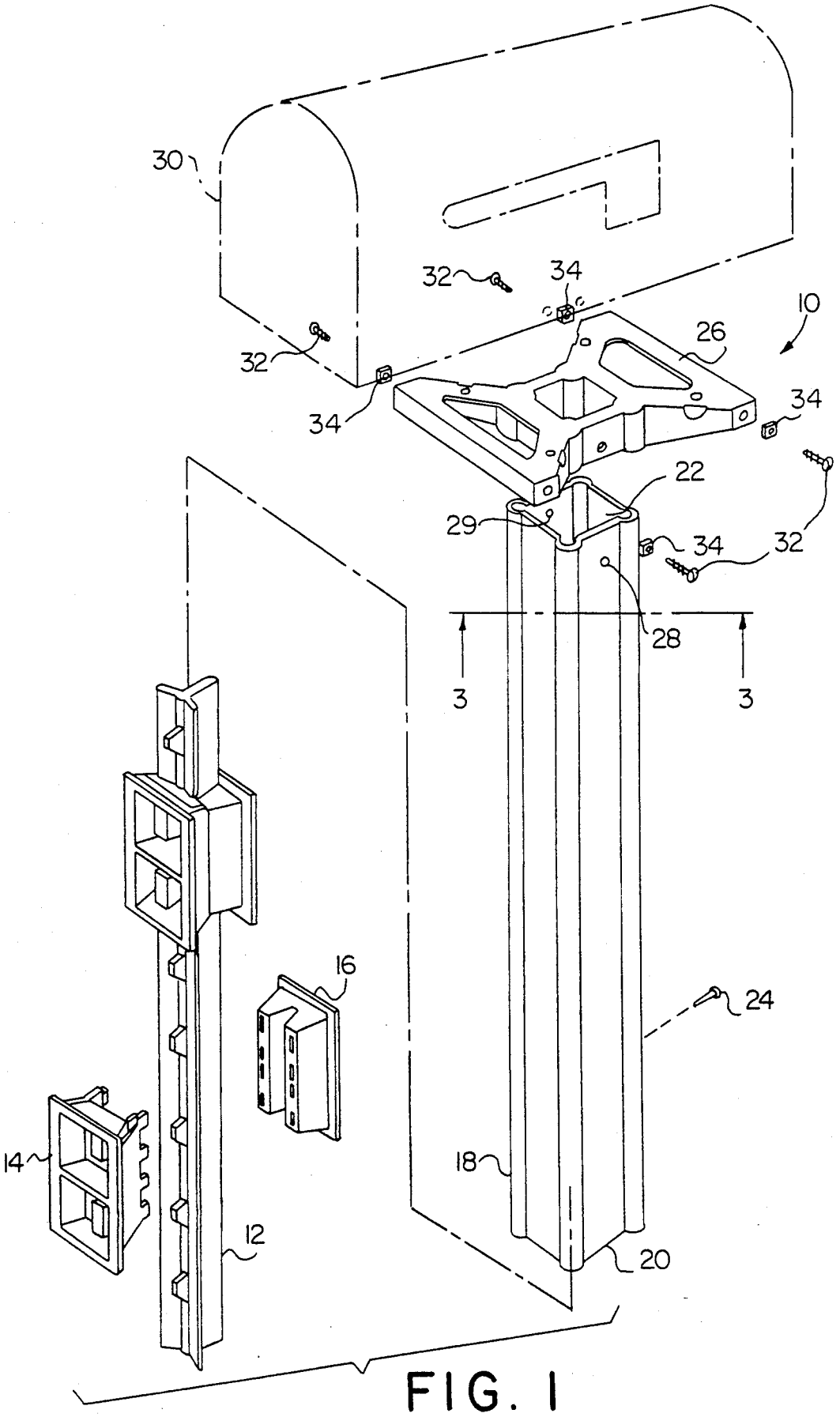
FIG. 1 of the drawings is an assembly exploded perspective view of the apparatus in accordance with the invention showing a ground mount stake, spacer members, a hollow post member, a mounting plate and a standard mailbox.

As shown in FIG. 1, a mailbox support apparatus 10 includes ground mount stake 12 which is preferably made of a strong, durable material such as angle iron which may be easily hammered into the ground. Front spacer members 14 and rear spacer members 16 snap onto ground mount stake 12 as shown. Spacer members 14 and 16 provide a pressure fit once ground mount stake 12 is inserted into open end 20 of hollow post member 18 thereby securing hollow post member to ground mount stake 12 in a vertical orientation. Retaining rivet 24 is provided to further secure the hollow post member 18 to ground mount stake 12. Mounting plate 26 is secured to open end 22 of hollow post member 18 with a bolt (not shown) inserted through holes 28 and 29. Mailbox 30 attaches to mounting plate 26 with screws 32 and bolts 34.

Figure 2:
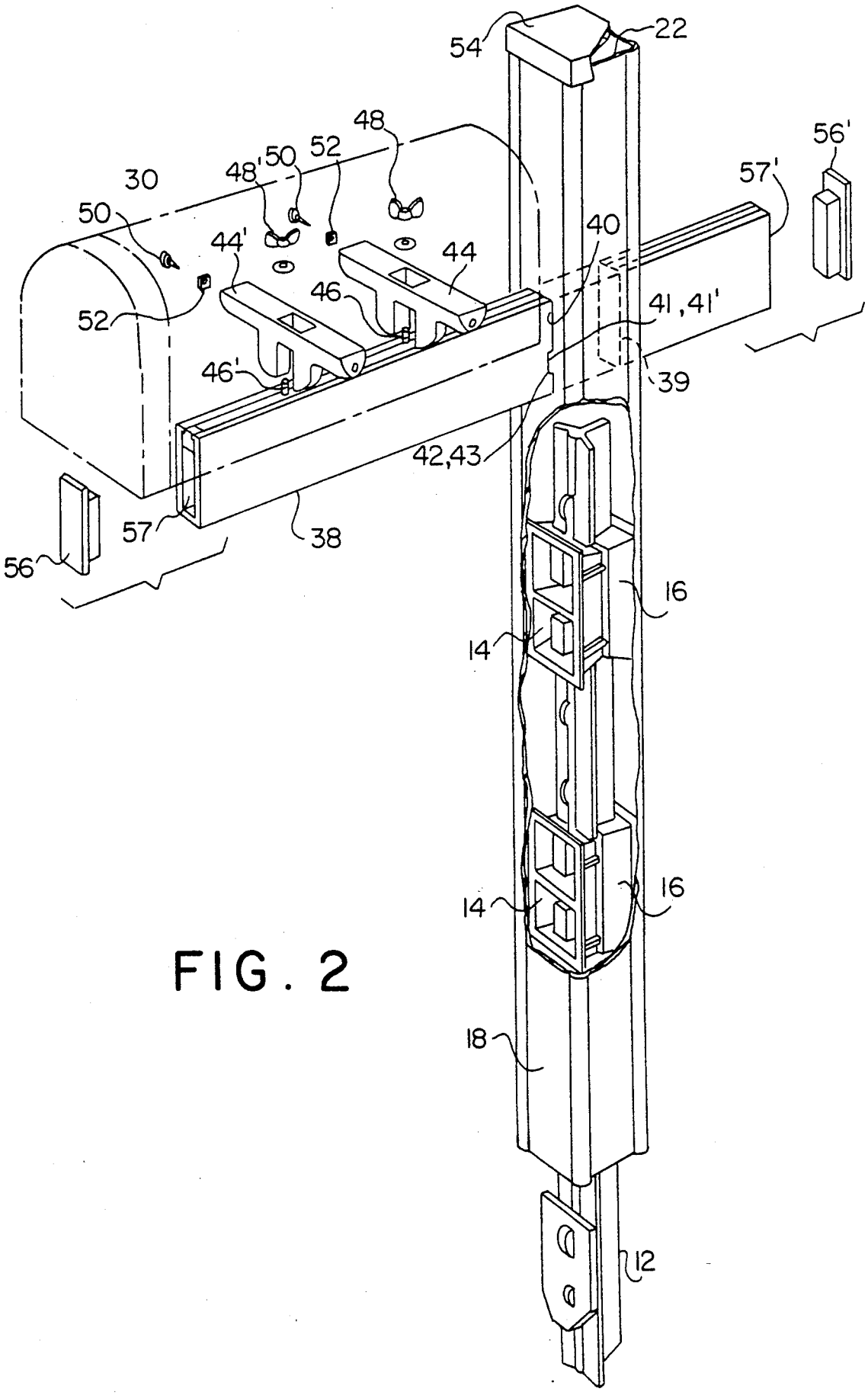
FIG. 2 of the drawings is an exploded perspective assembly view showing a modified embodiment of the apparatus whereby a cross arm and mounting brackets are utilized instead of the mounting plate of FIG. 1.

FIG. 2 depicts a modified mailbox support apparatus utilizing cross arm 38 transversely inserted through longitudinal slot 39 and similar slot 40 disposed opposite and parallel to slot 39. Once inserted, tooth members 41 and 41' located on the inside edge of longitudinal slot 40, fit into aperture 42 which extends transversely through cross arm 38, and similar tooth members (not shown) fit into aperture 43 to secure cross arm 38 within hollow post member 18 in a horizontal orientation. Mounting brackets 44 and 44', attach to cross arm 38 with bolts 46 and 46' and wing nuts 48 and 48'. Screws such as that shown at 50 and nuts such a 52 may then be utilized to attach mailbox 30 to mounting brackets 44 and 44'. Top cap 54 snaps over open end 22 and end caps 56 and 56' snap into openings 57 and 57' respectfully as shown.

Figure 5:
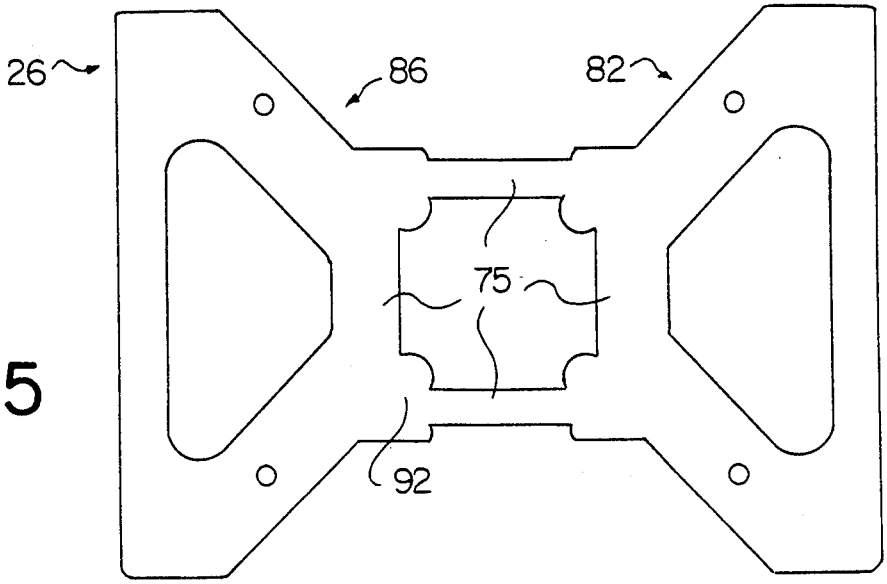
FIG. 5 of the drawings is a plan view of the mounting plate.
Figure 4:
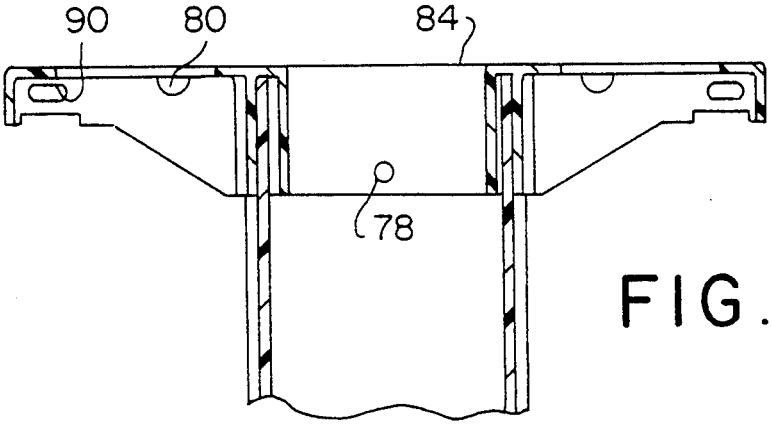
FIG. 4 of the drawings is a side elevation of the mounting plate of FIG. 3.
Figure 3:
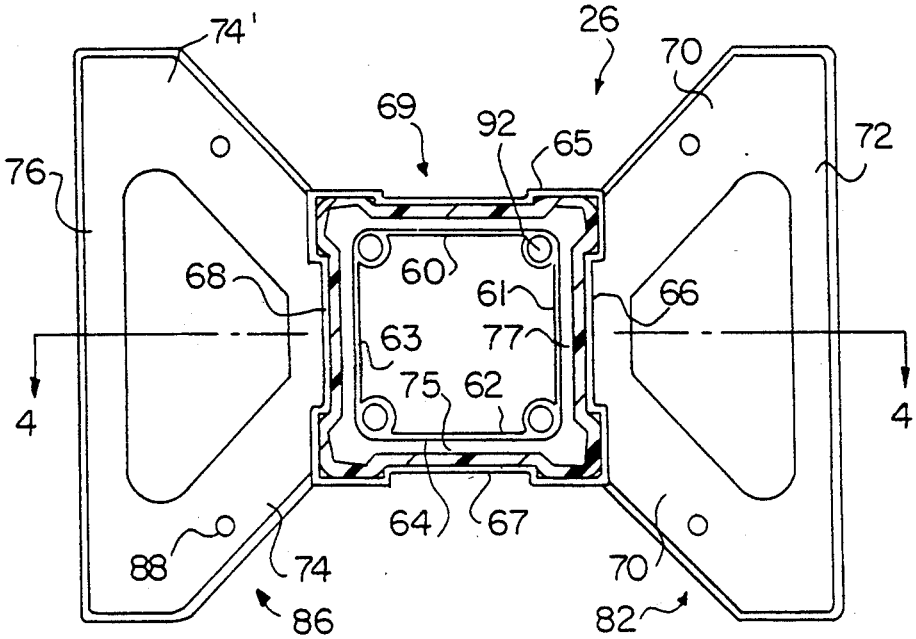
FIG. 3 of the drawings is a bottom view of the mounting plate utilized in the present invention.

FIG. 3 is an enlarged bottom view of mounting plate 26. As shown, sides 60, 61, 62 and 63 combine to form inside wall 64 and sides 65, 66, 67 and 68 form outside wall 69. Inside wall 64 and outside wall 69 are connected by rigid membrane 75 (best seen in FIG. 5) and define a rectangular channel 77 which receives hollow post member 18 at open end 22 as depicted in FIG. 1. Arms 70 and 70' extend obliquely outwardly from side 66 of outside wall 69 and are joined together with stiff webbing 72 to form generally flat member 82. Similarly, arms 74 and 74' extend obliquely outwardly from side 68 of outside wall 69 and are joined together with stiff webbing 76 to form generally flat member 86. As seen from FIG. 5, generally flat members 82 and 86 and rigid member 75 all lie in the same plane to form generally flat surface 84 (FIG. 4). A set of four holes, one of which being 88 is used in mounting a standard mailbox of one size while an alternate set of four apertures, one of which being 90 shown in FIG. 4, is utilized in mounting a standard mailbox of a different size. Hole 78 corresponds with hole 28 in hollow post member 18 and is utilized with a nut and bolt assembly (not shown) to attach mounting plate 26 to hollow post member 18. Also shown in FIG. 4 is access slot 80 provided to facilitate the use of a wrench when tightening down mailbox 30 to mounting plate 26 when using holes 88. Note that covered holes 92 shown in FIG. 5, have been provided so that the mounting plate may be attached to a wooden post with screws or bolts (not shown).

Figure 6:
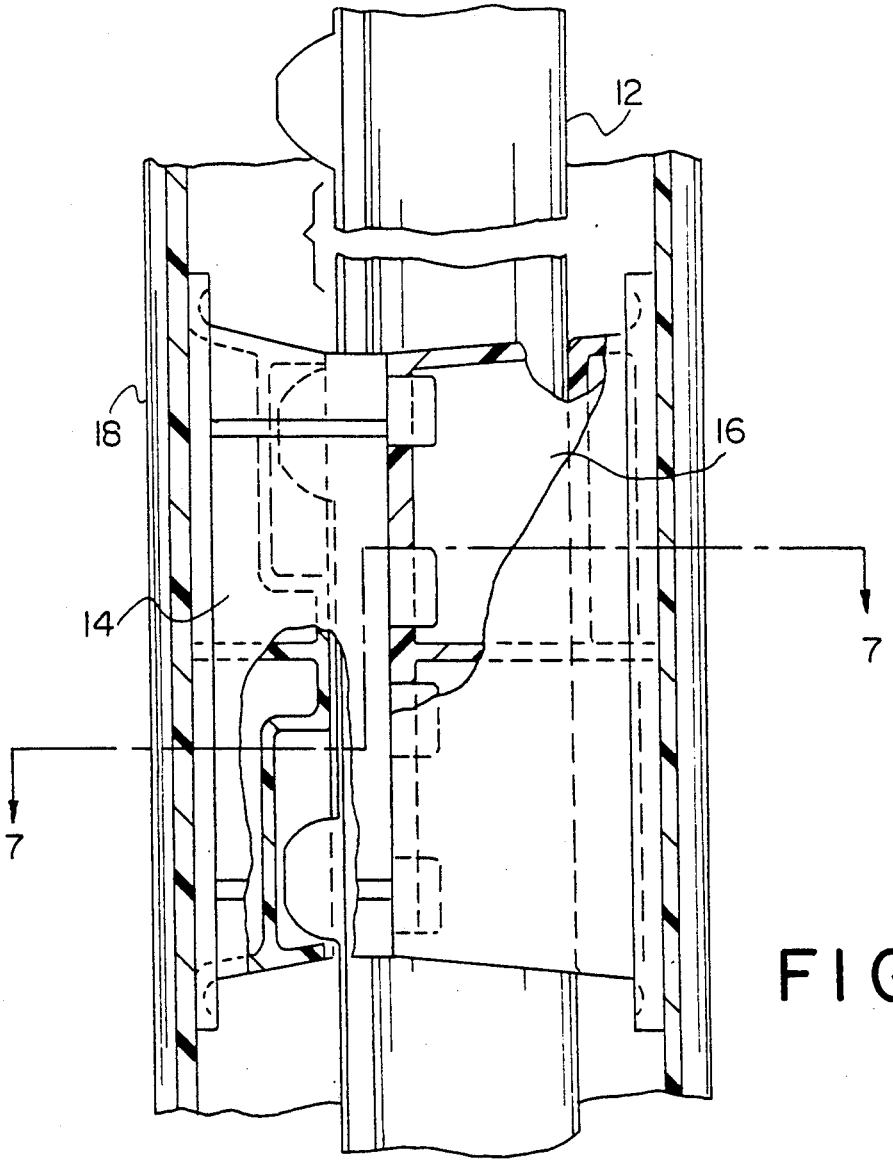
FIG. 6 of the drawings is a cross section cutaway view showing orientation of spacer members and ground mount stake to hollow post member.

FIG. 6 illustrates a partial cross section of hollow post member 18 with spacer members 14 and 16 snapped onto ground mount stake 12 and inserted into hollow post member 18.

Figure 7:
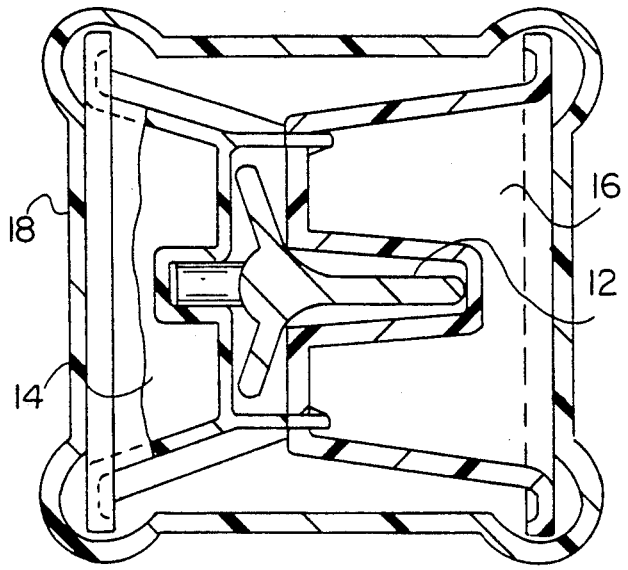
FIG. 7 of the drawings is a cross sectional view along the line 7—7.

FIG. 7 is a top view of FIG. 6 along lines 7—7 showing orientation of spacer members 14 and 16 with ground mount stake 12 to hollow post member 18.

It is thus seen that the present invention provides an improved apparatus for attractively and inexpensively supporting a mailbox. It is further seen that the present invention provides a mailbox support apparatus which is readily assembled. As many variations are apparent to one of skill in the art from a reading of the above specification, such variations are within the spirit and scope of the instant invention as defined by the following appended claims.

That which is claimed:

1. A mailbox support apparatus comprising:

a ground mount stake;

a hollow post member of greater diameter than said ground mount stake, said hollow post member having a first open end and a second open end remote from and parallel to said first open end;

spacer members detachably mountable upon said ground mount stake and sized to provide a pressure fit of said hollow post member upon said ground mount stake when said ground mount stake with said spacer members mounted thereon is longitudinally inserted into the first open end of said hollow post member;

a mounting plate;

means for attaching said mounting plate to said second open end of said hollow post member; and means for attaching said mounting plate to a bottom of a mailbox.

2. The apparatus according to claim 1 wherein said ground mount stake is a section of angle iron.

3. The apparatus of claim 1 wherein said means for attaching said spacer members to said ground mount stake is separate front members and rear members which snap into said ground mount stake.

4. A mailbox support apparatus comprising;

a ground mount stake;

a hollow post member of greater diameter than said ground mount stake, said hollow post member having a first open end and a second open end remote from and parallel to said first open end, whereby said ground mount stake is longitudinally insertable into said first open end;

a first longitudinal slot along one wall of said hollow post member, said slot perpendicular to said first and second open ends, a second longitudinal slot disposed opposite and parallel to said first longitudinal slot;

a cross arm transversely insertable through said first and second longitudinal slots;

fastening means to secure said cross arm to said hollow post member;

spacer members;

means for attaching said spacer members to said ground mount stake whereby said ground mount stake with said spacer members thereon is longitudinally insertable into said first open end in said hollow post member and appropriately sized to establish a pressure fit thereby securing said hollow post member to said ground mount stake;

a pair of mounting brackets;

means for attaching said mounting brackets to said cross arm;

means for attaching a mailbox to said mounting brackets.

5. The apparatus according to claim 4 wherein said ground mount stake is a section of angle iron.

6. The apparatus of claim 4 wherein said means for attaching said spacer members to said ground mount stake are separate front members and rear members fitted around said ground mount stake and snapped together thereby clamping onto said ground mount stake.

7. The apparatus of claim 4 wherein said fastening means to secure said cross arm to said hollow post member comprises;

tooth members along the inner edges of said first and second longitudinal slots;

apertures placed along the walls of said cross arm and aligned with said tooth members so as to receive and retain said tooth members once said cross arm is pressed into proper alignment.

8. A mailbox support apparatus comprising:

a ground mount stake;

a hollow post member of greater diameter than said ground mount stake, said hollow post member having a first open end and a second open end remote from and parallel to said first open end;

spacer members detachably mountable upon said ground mount stake and sized to provide a pressure fit of said hollow post member upon said ground mount stake when said ground mount stake with said spacer members mounted thereon is longitudinally inserted into the first open end of said hollow post member;

a mounting plate comprising:

a generally rectangular channel defining a generally rectangular opening in the center thereof, said channel receiving said second open end of said hollow post member, and said channel being defined by parallel, opposed inside and outside walls each having four sides connected by a rigid membrane disposed opposite and parallel to said rectangular opening; and a first generally flat member extending from a first side of said outside wall, said flat member having two arms extending obliquely outwardly from each corner of said first side, said arms jointed together at the ends by a solid, stiff webbing, a second generally flat member extending from a second side of said outside wall, said second side opposite and parallel to said first side of said outside wall, said first and second generally flat members being parallel and in the same plane as said solid membrane, whereby a generally flat surface suited for flush contact with the bottom of said mailbox is provided;

means for attaching said mounting plate to said second open end of said hollow post member; and means for attaching said mounting plate to a bottom of a mailbox.

9. A mailbox support apparatus comprising:

a ground mount stake;

a hollow post member of greater diameter than said ground mount stake, said hollow post member having a first open end and a second open end remote from and parallel to said first open end;

spacer members detachably mountable upon said ground mount stake and sized to provide a pressure fit of said hollow post member upon said ground mount stake when said ground mount stake with said spacer member mounted thereon is longitudinally inserted into the first open end of said hollow post member;

a mounting plate defining two sets of four holes each for utilizing bolts to attach said mailbox to said mounting plate, each said set of holes so arranged as to correspond with one of two standard sizes of mailboxes so that said mounting plate may accommodate both standard sizes of mailboxes, said mounting plate comprising:

a generally rectangular channel defining a generally rectangular opening in the center thereof, said channel receiving said second open end of said hollow post member, and said channel being defined by parallel, opposed inside and outside walls each having four sides connected by a rigid membrane disposed opposite and parallel to said rectangular opening; and a first generally flat member extending from a first side of said outside wall, said flat member having two arms extending obliquely outwardly from each corner of said first side, said arms joined together at the ends by a solid, stiff webbing, a second generally flat member extending from a second side of said outside wall, said second side opposite and parallel to said first side of said outside wall, said first and second generally flat members being parallel and in the same plane as said solid membrane, whereby a generally flat surface suited for flush contact with the bottom of said mailbox is provided;

means for attaching said mounting plate to said second open end of said hollow post member; and means for attaching said mounting plate to a bottom of a mailbox.

* * * * *